US009657570B2

(12) United States Patent
Markowski, III

(10) Patent No.: US 9,657,570 B2
(45) Date of Patent: May 23, 2017

(54) PULSE JET LIQUID GAS CLEANING SYSTEM

(71) Applicant: United Technologies Corporation, Hartford, CT (US)

(72) Inventor: John E. Markowski, III, Berlin, CT (US)

(73) Assignee: United Technologies Corporation, Farmington, CT (US)

( * ) Notice: Subject to any disclaimer, the term of this patent is extended or adjusted under 35 U.S.C. 154(b) by 358 days.

(21) Appl. No.: 14/202,805

(22) Filed: Mar. 10, 2014

(65) Prior Publication Data

US 2014/0251381 A1 Sep. 11, 2014

Related U.S. Application Data

(60) Provisional application No. 61/776,357, filed on Mar. 11, 2013.

(51) Int. Cl.

| | |
|---|---|
| ***B08B 3/12*** | (2006.01) |
| ***B08B 5/04*** | (2006.01) |
| ***B08B 7/00*** | (2006.01) |
| ***F01D 5/00*** | (2006.01) |
| ***B08B 3/02*** | (2006.01) |
| ***B24C 1/00*** | (2006.01) |

(52) U.S. Cl.

CPC ..... *F01D 5/005* (2013.01); *B08B 3/02* (2013.01); *B08B 3/12* (2013.01); *B08B 5/04* (2013.01); *B08B 7/0092* (2013.01); *B24C 1/003* (2013.01); *B08B 2203/0288* (2013.01); *F05D 2230/10* (2013.01); *Y10T 137/0391* (2015.04); *Y10T 137/206* (2015.04)

(58) Field of Classification Search

CPC .... B08B 3/12; B08B 5/00; B08B 3/02; B08B 5/04; B08B 7/0092; B08B 2203/0288; F01D 5/005; B24C 1/003; Y10T 137/0391; Y10T 137/206; F05D 2230/10

USPC ..... 134/1

See application file for complete search history.

(56) References Cited

U.S. PATENT DOCUMENTS

| | | | | |
|---|---|---|---|---|
| 5,421,517 | A | 6/1995 | Knudson et al. | |
| 6,489,707 | B1 * | 12/2002 | Guerrero | G10K 15/04 310/334 |
| 6,725,540 | B2 | 4/2004 | Bose et al. | |
| 7,186,167 | B2 | 3/2007 | Joslin | |
| 7,310,955 | B2 | 12/2007 | Hume et al. | |
| 7,316,363 | B2 | 1/2008 | Hume et al. | |
| 7,360,678 | B2 | 4/2008 | Pietruska et al. | |
| 7,600,387 | B2 | 10/2009 | Hume et al. | |
| 2005/0003737 | A1 * | 1/2005 | Montierth | A61B 8/546 451/5 |
| 2008/0213978 | A1 * | 9/2008 | Henry | B08B 5/00 438/462 |
| 2012/0061485 | A1 * | 3/2012 | Vijay | B26F 3/004 239/4 |

* cited by examiner

*Primary Examiner* — Saeed T Chaudhry
(74) *Attorney, Agent, or Firm* — O'Shea Getz P.C.

(57) ABSTRACT

A pulse jet liquid gas cleaning system has an ultrasonic transducer operable to transform a high-pressure stream of cryogenic fluid from a cryogenic fluid supply into pulsed jets of individual cryogenic fluid slugs.

7 Claims, 1 Drawing Sheet

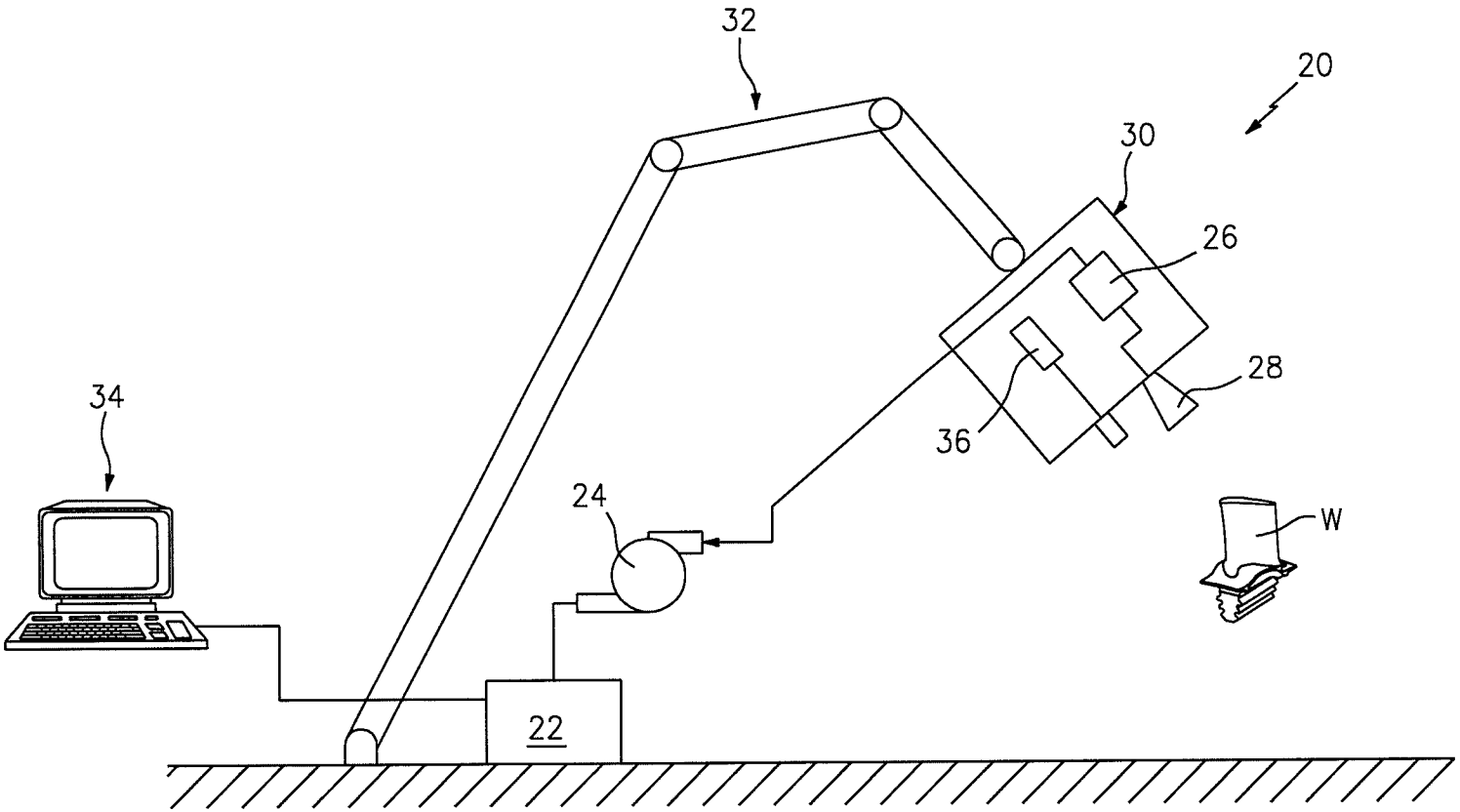
20
30
26
28
36
32
W
24
22
34

PULSE JET LIQUID GAS CLEANING SYSTEM

This application claims priority to U.S. Patent Appln. No. 61/776,357 filed Mar. 11, 2013.

BACKGROUND

The present disclosure relates to a cleaning system with a cryogenic liquid gas.

Gas turbine engine components are typically treated with various coatings. The overhaul and repair of aerospace components often requires the coatings to be stripped.

An effective alternative to chemical and mechanical processes includes high-pressure waterjet systems that strip the coatings in an environmentally benign procedure. The high-pressure waterjet systems process is also efficient in terms of cost, removal rates, and less damage to the underlying substrate material. The water, however, becomes mixed with the coatings and generates slurry of water and stripped coating remains. The slurry is typically processed through a water reclamation system to separate the water from the stripped coating remains.

SUMMARY

A pulse jet liquid gas cleaning system according to one disclosed non-limiting embodiment of the present disclosure includes an ultrasonic transducer operable to transform a high-pressure stream of cryogenic fluid from a cryogenic fluid supply into pulsed jets of individual cryogenic fluid slugs.

A further embodiment of the present disclosure includes, wherein the cryogenic fluid is nitrogen.

A further embodiment of any of the foregoing embodiments of the present disclosure includes, wherein the ultrasonic transducer is tunable.

A further embodiment of any of the foregoing embodiments of the present disclosure includes, wherein the ultrasonic transducer is tunable between about 20-130 Kilohertz.

A further embodiment of any of the foregoing embodiments of the present disclosure further includes a head unit within which the ultrasonic transducer is located.

A further embodiment of any of the foregoing embodiments of the present disclosure further includes a rotating nozzle in communication with the ultrasonic transducer in the head unit.

A further embodiment of any of the foregoing embodiments of the present disclosure further includes a vacuum within the head unit.

A method of cleaning according to another disclosed non-limiting embodiment of the present disclosure includes transforming a high-pressure stream of cryogenic fluid into pulsed jets of individual cryogenic fluid slugs.

A further embodiment of any of the foregoing embodiments of the present disclosure further includes transforming high-frequency electrical pulses into mechanical vibrations to transform the high-pressure stream of cryogenic fluid into pulsed jets of individual cryogenic fluid slugs.

A further embodiment of any of the foregoing embodiments of the present disclosure further includes tuning the pulsed jets between about 20-130 Kilohertz.

A further embodiment of any of the foregoing embodiments of the present disclosure further includes vacuuming a dry coating separated from a substrate by the pulsed jets of individual cryogenic fluid slugs which sublimate.

BRIEF DESCRIPTION OF THE DRAWINGS

Various features will become apparent to those skilled in the art from the following detailed description of the disclosed non-limiting embodiment. The drawings that accompany the detailed description can be briefly described as follows:

FIG. 1 is a schematic view of a pulse jet liquid gas cleaning system.

DETAILED DESCRIPTION

FIG. 1 schematically illustrates a pulse jet liquid gas cleaning system. The system 20 generally includes a cryogenic fluid supply 22, a cryopump 24, an ultrasonic transducer 26 and a high pressure rotating nozzle assembly 28. The ultrasonic transducer 26 and the high pressure rotating nozzle assembly 28 are generally that of the PurePulse™ waterjet technology from Pratt & Whitney Automation, Inc. (PWA) of Huntsville, Ala. USA. It should be appreciated that the system 20 may have more, less, or different components than those illustrated. Although not described in detail, each of the components may be coupled to one another via any suitable piping adapted to transport a suitable cryogen at various temperatures and pressures. This piping may include other suitable components, such as valves, pumps, and reducers, and may be any suitable size depending on the process criteria.

The cryogenic fluid supply 22 functions to store a cryogenic fluid such as nitrogen, typically in liquid form, although some gas nitrogen may be present. Although nitrogen is used throughout this detailed description as the cryogenic fluid, other suitable cryogens may be utilized. In addition, the term "fluid" may mean liquid, gas, vapor, supercritical or any combination thereof.

The ultrasonic transducer 26 and the high pressure rotating nozzle assembly 28 may be mounted on a head unit 30 positioned on a robot arm 32 so that the liquid gas cryogenic fluid jet is aimed thereby in response to a control subsystem 34. It should be understood that various control subsystems and mount arrangements may alternatively or additionally provided.

High-frequency electrical pulses from the ultrasonic transducer 26 are converted into mechanical vibrations that transform high-pressure streams of cryogenic fluid into pulsed jets of individual cryogenic fluid slugs. The cryogenic fluid slugs produce a pulse-wave effect on, for example, a coating to gradually fracture and remove the coating from a substrate W such as an aerospace component.

In another disclosed non-limiting embodiment, the ultrasonic transducer 26 may be of a tunable design so the fine-tuning of the ultrasonic pulse wave can be optimized. For example, a lower frequency such as twenty (20) Kilohertz may be utilized for rough cleaning and one hundred thirty (130) Kilohertz may be utilized for more delicate cleaning.

The liquid gas cryogenic fluid jet readily removes tough coatings such as High Velocity Oxygen Fuel (HVOF) Thermal Spray Coatings and the liquid gas cryogenic fluid then sublimes into a gas. The substrate is left unharmed and the coating will fall away dry. In another disclosed non-limiting embodiment, a vacuum system 36 may be mounted to the head unit 30 to facilitate removal of the dry coating. As the liquid gas cryogenic fluid sublimes into a gas no sludge is produced and the waste coating is readily recycled at lower waste coating disposal cost. Also, no water reclamation system is required to be a "green" technology.

Benefits of the system 20 include the ability to remove hard to remove coatings such as HVOF and also have delicate removal ability by adjustment of the liquid gas flow, pressure, and ultrasonic frequency.

It should be understood that like reference numerals identify corresponding or similar elements throughout the several drawings. It should also be understood that although a particular component arrangement is disclosed in the illustrated embodiment, other arrangements will benefit herefrom.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A pulse jet liquid gas cleaning system comprising:

a cryogenic fluid supply;

an ultrasonic transducer operable to transform high-pressure stream of cryogenic fluid from said cryogenic fluid supply into pulsed jets of individual cryogenic fluid slugs;

a vacuum operable to remove a dry coating separated from a substrate;

a head unit within which said ultrasonic transducer is located;

a robot arm; and a control subsystem, wherein the head unit is positioned on the robot arm, and wherein the control subsystem causes the cryogenic fluid slugs to be aimed at the substrate via the robot arm.

2. The system as recited in claim 1, wherein said cryogenic fluid is nitrogen.

3. The system as recited in claim 1, wherein said ultrasonic transducer is tunable.

4. The system as recited in claim 1, wherein said ultrasonic transducer is tunable between about 20-130 Kilohertz.

5. The system as recited in claim 1, further comprising a rotating nozzle in communication with said ultrasonic transducer in said head unit.

6. The system as recited in claim 5, wherein said vacuum is within said head unit.

7. The system as recited in claim 1, wherein the substrate is an aerospace component.

* * * * *